US009503820B2

(12) United States Patent
Hall et al.

(10) Patent No.: US 9,503,820 B2
(45) Date of Patent: *Nov. 22, 2016

(54) MULTI-MODE MICROPHONES

(71) Applicant: Silicon Audio Directional, LLC, Austin, TX (US)

(72) Inventors: Neal A. Hall, Austin, TX (US); Donghwan Kim, Austin, TX (US)

(73) Assignee: Silicon Audio Directional, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/604,389

(22) Filed: Jan. 23, 2015

(65) Prior Publication Data

US 2016/0219374 A1 Jul. 28, 2016

(51) Int. Cl.

| | |
|---|---|
| ***H04R 17/02*** | (2006.01) |
| ***H04R 1/04*** | (2006.01) |
| ***H04R 19/04*** | (2006.01) |
| ***H04R 25/00*** | (2006.01) |

(52) U.S. Cl.

CPC ..... *H04R 17/02* (2013.01); *H04R 1/04* (2013.01); *H04R 19/04* (2013.01); *H04R 25/00* (2013.01); *H04R 2201/003* (2013.01); *H04R 2217/01* (2013.01); *H04R 2225/55* (2013.01); *H04R 2499/11* (2013.01)

(58) Field of Classification Search

CPC ..... H04R 1/08; H04R 9/08; H04R 11/04; H04R 17/02; H04R 21/02; H04R 1/00; H04R 2205/022; H04R 2201/401; H04R 2201/405; H04R 2217/00–2217/03

USPC ..... 381/172–173, 182, 190, 369

See application file for complete search history.

(56) References Cited

U.S. PATENT DOCUMENTS

| | | | |
|---|---|---|---|
| 8,391,517 | B2 | 3/2013 | Avenson |
| 8,488,973 | B2 | 7/2013 | Avenson |
| 8,503,701 | B2 | 8/2013 | Miles |
| 8,531,088 | B2 | 9/2013 | Grosh |
| 8,896,184 | B2 | 11/2014 | Grosh |
| 2012/0250909 | A1 | 10/2012 | Grosh |

(Continued)

OTHER PUBLICATIONS

Carr, Dustin W. "MEMS and Optoelectronics Integration for Physical Sensors" 2007 (8 pages).

(Continued)

*Primary Examiner* — Suhan Ni

(74) *Attorney, Agent, or Firm* — Meyertons Hood Kivlin Kowert & Goetzel, P.C.; Jeffrey C. Hood; Brian E. Moore

(57) ABSTRACT

In some embodiments, a sensor system may include a deformable structure and a sensing element. The deformable structure may include at least one layer of piezoelectric material and at least one actuator port disposed on the at least one layer of piezoelectric material. The deformable structure may deform in response to external phenomenon. The at least one actuator port may be configured to actuate the at least one layer of piezoelectric material via application of an electrical signal to the at least one layer of piezoelectric material. The at least one layer of piezoelectric material may be configured to apply a force to the deformable structure when actuated. The sensing element may be configured to sense deformation of the deformable structure capacitively, optically, or via a sensing port according to embodiments.

50 Claims, 11 Drawing Sheets

(56) References Cited

U.S. PATENT DOCUMENTS

2016/0007125 A1* 1/2016 Lee ..... H04R 31/003 381/172
2016/0014526 A1* 1/2016 Miyoshi ..... H01L 41/183 381/190

OTHER PUBLICATIONS

Degertekin, F. Levent; Neal A. Hall; Wook Lee; "Capacitive Micromachined Ultrasonic Transducers with Integrated Optoelectronic Readout" IEEE Ultrasonics Symposium, vol. 2, pp. 875-881; Oct. 7-10, 2001 (7 pages).
Dehe, Alfons; Martin Wurzer; Marc Fuldner; Ulrich Krumbein; "The Infineon Silicon MEMS Microphone" AMA Conferences 2013: Sensor 2013 (May 14-16, 2013), Opto 2013, IRS 2013; DOI 10.5162/sensor2013/A4.3 (5 pages).
Guldiken, Rasim O.; Jeff McLean; F. Levent Degertekin; "CMUTS with Dual-Electrode Structure for Improved Transmit and Receive Performance" IEEE Transactions on Ultrasonics, Ferroelectrics, and Frequency Control, vol. 53, No. 2, Feb. 2006; pp. 483-491 (9 pages).
Hall, Neal A. "Electrostatic MEMS Microphones" in Encyclopedia of Nanotechnology, 2012; pp. 775-783, publisher: Springer, Netherlands (9 pages).
Kim, Donghwan; Caesar T. Garcia; Brad Avenson; Neal A. Hall; "Design and Experimental Evaluation of a Low-Noise Backplate for a Grating-Based Optical Interferometric Sensor" Journal of Microelectromechanical Systems, vol. 23, No. 5, Oct. 2014; pp. 1101-1111 (11 pages).
Kim, Donghwan; Nishshanka N. Hewa-Kasakarage; Neal A. Hall; "A Theoretical and Experimental Comparison of 3-3 and 3-1 Mode Piezoelectric Microelectromechanical Systems (MEMS)" in Sensors and Actuators A: Physical; Aug. 2014; pp. 112-122; Elsevier B.V. (11 pages).
Kim, Donghwan; Neal A. Hall; "Towards a Sub 15-dBA Optical Micromachined Microphone" Journal of Acoustical Society of America, vol. 135, No. 5, May 2014, pp. 2664-2673 (10 pages).
Kuntzman, Michael L.; Neal A. Hall; "A Broadband, Capacitive, Surface-micromachined, Omnidirectional Microphone with More than 200 kHz Bankwidth" Journal of Acoustical Society of America, vol. 135, No. 6, Jun. 2014, pp. 3416-3424 (9 pages).
Kuntzman, Michael L.; Caesar T. Garcia, A. Guclu Onaran, Brad Avenson, Karen D. Kirk, Neal A. Hall; "Performance and Modeling of a Fully Packaged Micromachined Optical Microphone" Journal of Microelectromechanical Systems, vol. 20, No. 4, Aug. 2011, pp. 828-833 (6 pages).
Littrell, Robert; Karl Grosh; "Session 2pEAa: Computational Methods in Transducer Design, Modeling, Simulation, and Optimization I" ICA Proceedings of Meetings on Acoustics, Montreal, Canada, Jun. 2-7, 2013; published by the Acoustical Society of America through the American Institute of Physics, vol. 19, 2013 (9 pages).
Trolier-McKinstry, S. and P. Muralt "Thin Film Piezoelectrics for MEMS" Journal of Electroceramics, vol. 12; Jul. 17, 2004; Kluwer Academic Publishers, Netherlands (11 pages).

* cited by examiner

MULTI-MODE MICROPHONES

FIELD OF THE INVENTION

This disclosure relates generally to microphones, and more particularly to multi-mode microphones for use in, for example, cellular telephones and hearing aids.

DESCRIPTION OF THE RELATED ART

Miniature microphones, which may be used in a variety of applications (e.g., defense, cellular telephones, laptop computers, portable consumer electronics, hearing aids), generally include a compliant membrane and a rigid back electrode in close proximity to form a capacitor with a gap. In consumer electronics, microelectromechanical-system (MEMS) capacitive microphones are widely used with many advantages such as a competitive price and performance suitable for consumer electronic applications. Most conventional MEMS microphones on the market consist of a pressure-sensitive compliant diaphragm and a rigid backplate in close proximity to form an active capacitor. Sound is detected by measuring capacitance change due to incoming sound pressure which displaces the sensitive diaphragm. In other words, incoming sound waves induce vibrations in the compliant diaphragm and these vibrations change the capacitance of the structure which can be sensed with electronics.

FIGS. 1A and 1B depict a MEMS microphone package according to the prior art. FIG. 1A illustrates a silicon microphone die (i.e., MEMS die 100), which includes diaphragm 105 and perforated backplate 110 which are separated by a thin air gap 125. To form a functional omnidirectional microphone, the MEMS die 100 is configured such that only one side of diaphragm 105 is exposed to sound pressure, with the opposing side in contact with a sealed back-volume or back-side cavity. The diaphragm includes a vent 115 and is disposed on an electrical isolation layer 165 which electrically isolates the diaphragm 105 from the perforated backplate 110. Note that vent 115 enables low frequency pressure variations to equalize on front and back sides of diaphragm 105, and thereby limits the diaphragm 105 motion in response to low frequency sound. The perforated backplate 110 is sandwiched between the electrical isolation layer 165 and DSE (deep silicon etching) etch stop layer 130 of bulk silicon (SI) base 135. The diaphragm and perforated backplate structure are disposed on bulk SI base 135.

A typical prior art MEMS microphone package 102 is illustrated in FIG. 1B. MEMS microphone package 102 includes MEMS die 100, a substrate (e.g. a printed circuit board (PCB 120)), an application-specific integrated circuit (ASIC 130), and a cap (cap 140). The MEMS die 100 is disposed on PCB 120 and electrically coupled to ASIC 130. PCB 120 includes contacts 160 for incorporation into a variety of applications. Sound pressure enters through a hole in the PCB, such as sound inlet (bottom) 150. The sound pressure enters front volume 160 and is applied to one side of the diaphragm. The opposing side is in contact with back-volume 170 formed by PCB 120 and cap 140. An alternative configuration (also shown as sound inlet (top) 155) is sometimes used where the sound inlet resides on cap 140, and no sound inlet resides on PCB 120.

FIG. 2 illustrates a cross-sectional schematic of a typical prior art MEMS microphone die such as MEMS microphone die 100. As shown, diaphragm 105 functions as a top electrode of a variable capacitor. Perforated backplate 110 functions as the bottom electrode of the variable capacitor.

Thus, when sound pressure is applied to the diaphragm, the displacement of the diaphragm relative to the backplate changes the capacitance of the variable capacitor. The change in capacitance due to the deformation of the diaphragm may be used to determine sound pressure.

Further improvements in the field are desired.

SUMMARY OF THE INVENTION

Various embodiments of multi-mode microphones that improve linearity and sensitivity are presented herein. In one embodiment, a sensor system may include a deformable structure and a sensing element. The deformable structure may include at least one layer of piezoelectric material and at least one actuator port disposed on the at least one layer of piezoelectric material. The at least one actuator port may be configured to actuate the at least one layer of piezoelectric material via application of an electrical signal to the at least one layer of piezoelectric material. The at least one layer of piezoelectric material may be configured to apply a force to the deformable structure when actuated. The sensing element may be configured to sense deformation of the deformable structure.

In one embodiment, a multi-mode microphone system may include a substrate (e.g. a printed circuit board (PCB)), a multi-mode microphone coupled to the substrate, and a processing element electrically coupled to the substrate and multi-mode microphone. The substrate may include at least one sound inlet. The multi-mode microphone may include a cavity and a deformable structure as described in the above embodiment. The processing element may be configured to sense deformation of the deformable structure and provide the electrical signal to at least one actuator port of the deformable structure. The processing element may be further configured to detect a capacitance change with respect to a reference electrode during deformation of the deformable structure. In some embodiments, the processing element may be further configured to base the electrical signal applied to at least one actuator port on a measured capacitance change between an electrode disposed on or comprised in the deformable structure and a reference electrode. In other embodiments, the processing element may be further configured to sense deformation of the deformable structure based on interference of light. In yet other embodiments, the processing element may be further configured to detect deformation of a deformable structure via a signal generated by at least one sensing port and the at least one sensing port may be in contact with or coupled to a region of the deformable structure. The at least one sensing port may be configured to generate a signal in response to the deformation.

In one embodiment, a method may include a processing element performing sensing deformation of a deformable structure as described in any of the above embodiments and in response to the sensing, applying the electrical signal to the at least one actuator port. In some embodiments, the sensing may include the processing element sensing a capacitance change with respect to a reference electrode during deformation of the deformable structure. In other embodiments, the sensing may include the processing element performing sensing, via an optical sensing element, deformation of the deformable structure based on interference of light and the optical sensing element may include a light source, a beamsplitter, and the an optical sensor. In other embodiments, the sensing may include sensing the deformation via deformation of piezoelectric material.

This Summary is intended to provide a brief overview of some of the subject matter described in this document. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The following detailed description makes reference to the accompanying drawings, which are now briefly described.

Figure 1A:
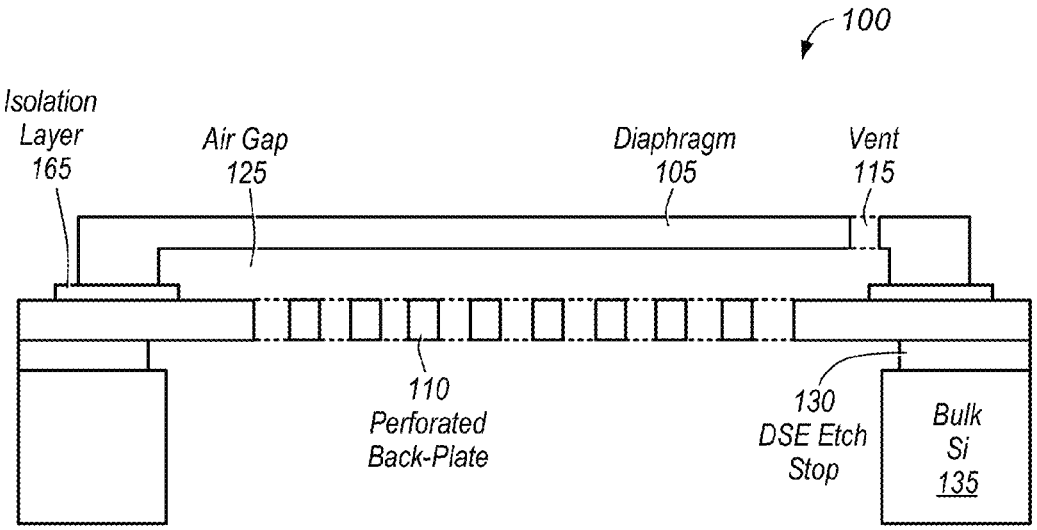
FIG. 1A (Prior Art)
FIG. 1A-1B illustrate a MEMS microphone according to prior art.
Figure 1B:
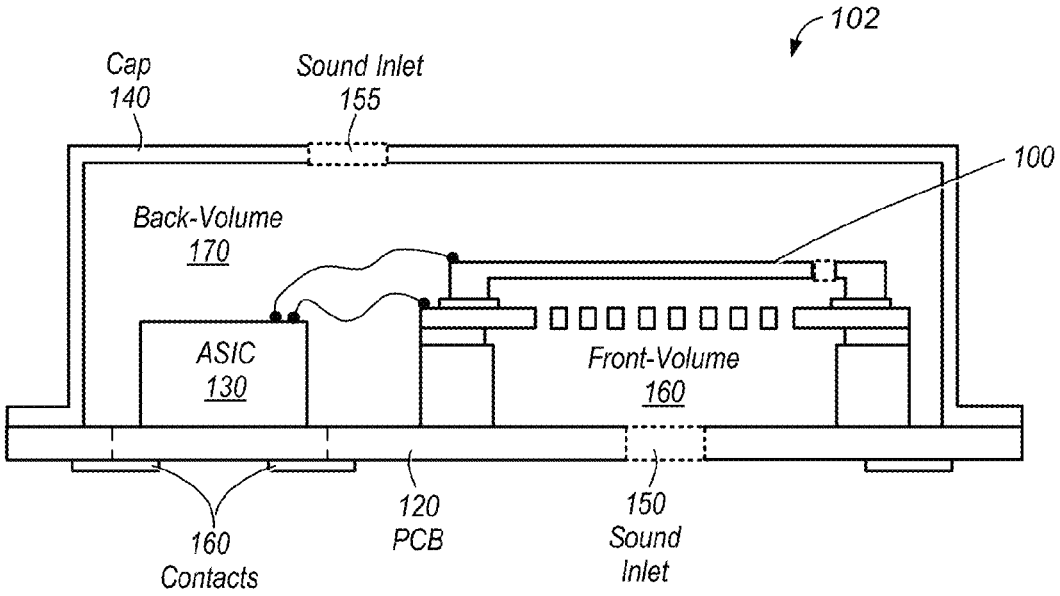
FIG. 1B (Prior Art)
Figure 2:
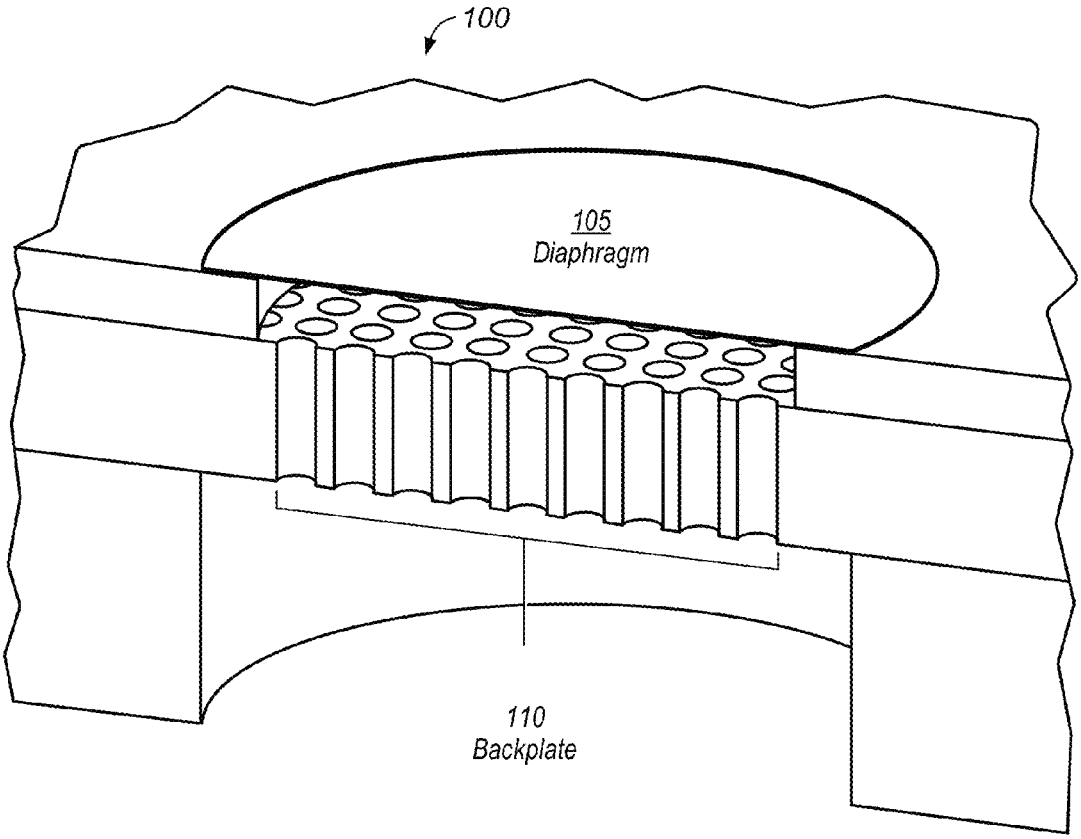
FIG. 2 (Prior Art)
FIG. 2 illustrates a three dimensional cross-section schematic of a MEMS microphone according to prior art.

While the invention is susceptible to various modifications and alternative forms, specific embodiments thereof are shown by way of example in the drawings and are herein described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. For example, a "third component electrically connected to the module substrate" does not preclude scenarios in which a "fourth component electrically connected to the module substrate" is connected prior to the third component, unless otherwise specified. Similarly, a "second" feature does not require that a "first" feature be implemented prior to the "second" feature, unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task (e.g., a set of electrical conductors may be configured to electrically connect a module to another module, even when the two modules are not connected). In some contexts, "configured to" may be a broad recitation of structure generally meaning "having circuitry that" performs the task or tasks during operation. As such, the component can be configured to perform the task even when the component is not currently on. In general, the circuitry that forms the structure corresponding to "configured to" may include hardware circuits.

Various components may be described as performing a task or tasks, for convenience in the description. Such descriptions should be interpreted as including the phrase "configured to." Reciting a component that is configured to perform one or more tasks is expressly intended not to invoke 35 U.S.C. §112, paragraph six, interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

DETAILED DESCRIPTION OF THE INVENTION

Terms

Approximately—refers to a value that is almost correct or exact. For example, approximately may refer to a value that is within 1 to 10 percent of the exact (or desired) value. It should be noted, however, that the actual threshold value (or tolerance) may be application dependent. For example, in one embodiment, "approximately" may mean within 0.1% of some specified or desired value, while in various other embodiments, the threshold may be, for example, 2%, 3%, 5%, and so forth, as desired or as required by the particular application. Furthermore, the term approximately may be used interchangeable with the term substantially. In other words, the terms approximately and substantially are used synonymously to refer to a value, or shape, that is almost correct or exact.

Couple—refers to the combining of two or more elements or parts. The term "couple" is intended to denote the linking of part A to part B, however, the term "couple" does not exclude the use of intervening parts between part A and part B to achieve the coupling of part A to part B. For example, the phrase "part A may be coupled to part B" means that part A and part B may be linked indirectly, e.g., via part C. Thus part A may be connected to part C and part C may be connected to part B to achieve the coupling of part A to part B.

Functional Unit (or Processing Element)—refers to various elements or combinations of elements. Processing elements include, for example, circuits such as an ASIC (Application Specific Integrated Circuit), portions or circuits of individual processor cores, entire processor cores, individual processors, programmable hardware devices such as a field programmable gate array (FPGA), and/or larger portions of systems that include multiple processors, as well as any combinations thereof.

Processing Element (or Functional Unit)—refers to various elements or combinations of elements. Processing elements include, for example, circuits such as an ASIC (Application Specific Integrated Circuit), portions or circuits of individual processor cores, entire processor cores, individual processors, programmable hardware devices such as a field programmable gate array (FPGA), and/or larger portions of systems that include multiple processors.

Programmable Hardware Element—includes various hardware devices comprising multiple programmable function blocks connected via a programmable interconnect. Examples include FPGAs (Field Programmable Gate Arrays), PLDs (Programmable Logic Devices), FPOAs (Field Programmable Object Arrays), and CPLDs (Complex PLDs). The programmable function blocks may range from fine grained (combinatorial logic or look up tables) to coarse grained (arithmetic logic units or processor cores). A programmable hardware element may also be referred to as "reconfigurable logic".

Computer System—any of various types of computing or processing systems, including a personal computer system (PC), mainframe computer system, workstation, network appliance, Internet appliance, personal digital assistant (PDA), television system, grid computing system, or other device or combinations of devices. In general, the term "computer system" can be broadly defined to encompass any device (or combination of devices) having at least one processor that executes instructions from a memory medium.

User Equipment (UE) (or "UE Device")—any of various types of computer systems devices which are mobile or portable and which performs wireless communications. Examples of UE devices include mobile telephones or smart phones (e.g., iPhone™, Android™-based phones), portable gaming devices (e.g., Nintendo DS™, PlayStation Portable™, Gameboy Advance™, iPhone™), laptops, wearable devices (e.g. smart watch, smart glasses), PDAs, portable Internet devices, music players, data storage devices, or other handheld devices, etc. In general, the term "UE" or "UE device" can be broadly defined to encompass any electronic, computing, and/or telecommunications device (or combination of devices) which is easily transported by a user and capable of wireless communication.

Deformable Structure—refers to any structure that may deform in response to an external phenomenon such as a pressure or an acceleration. May comprise multiple elements or members including taught or tensioned membranes. A deformable structure may be, or include elements that may be, completely supported along a perimeter (e.g., such as a diaphragm). A deformable structure may also be, or include elements that may be, not completely supported along at least one side of a perimeter (e.g., such as a cantilever beam).

Deformable Element—refers to an element or layer of a deformable structure that may deform in response to an external phenomenon such as a pressure or an acceleration. A deformable element may be a material such as silicon or may be a layer of piezoelectric material. A deformable element may be fully supported along its perimeter (e.g., a diaphragm) or may not be completely supported along at least one side of its perimeter (e.g., a cantilever beam).

Piezoelectric Structure—refers to at least one layer of piezoelectric material with at least one electrode disposed on the at least one layer of piezoelectric material.

Trans-impedance amplifier—refers to a current to voltage converter, most often implemented using an operational amplifier.

Piezoelectric sensor—refers to a sensor that relies on the piezoelectric effect, i.e., the electromechanical interaction between the mechanical and the electrical state in a certain class of materials.

Open-circuit voltage—refers to the difference of electrical potential between two terminals of a device when disconnected from any circuit.

Short-circuit charge—refers to charge moved between electrodes of a sensor when the voltage across the sensor is zero.

Short-circuit current—refers to the current moved between electrodes of a sensor when the voltage across the sensor is zero.

Audio Spectrum—refers to the portion of the frequency spectrum that is audible to humans. In general, audible frequencies range from approximately 20 Hz on the low end to 20,000 Hz on the high end. Thus, the audio spectrum is considered to span from 20 Hz to 20 kHz. In general, the center of the audio spectrum may be considered to be approximately 1 kHz.

Wave number—refers to the spatial frequency of a wave, either in cycles per unit distance or radians per unit distance.

Figure 3:
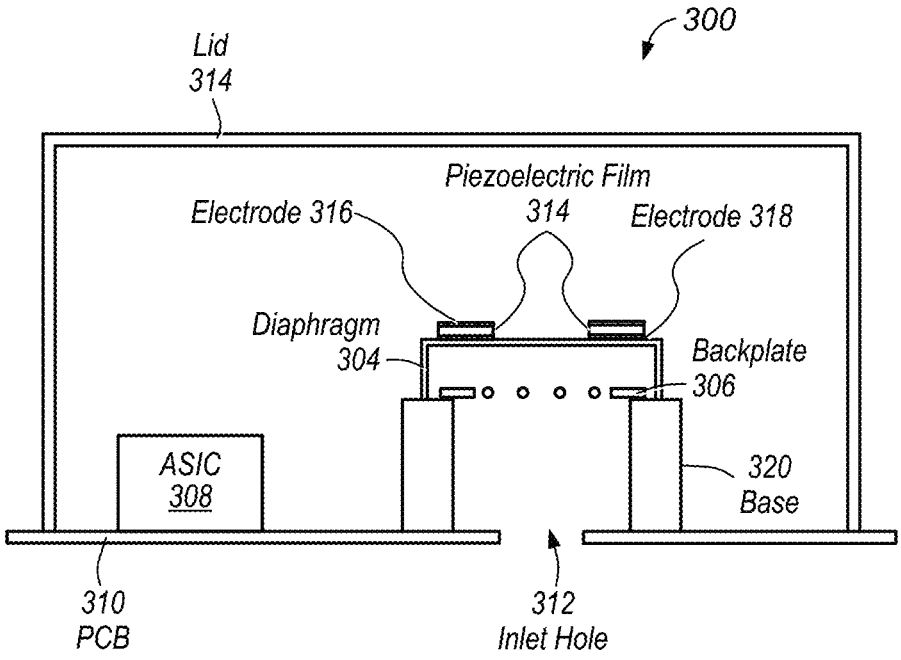
FIG. 3 illustrates a multi-mode microphone according to one embodiment.

FIGS. 3-5: Embodiments of a Multi-Mode Capacitive Microphone

There are at least two relevant metrics for measuring the performance of MEMS microphones: (1) the noise floor (the lowest detectable input pressure) or minimum detectable pressure (MDP) and (2) dynamic range (DR) or acoustic overload pressure (AOP). FIG. 3 illustrates multi-mode microphone 300 according to one embodiment. Multi-mode microphone 300, described in detail below, includes means for increasing DR as compared to the prior art. As illustrated, piezoelectric film 314 may be disposed between top electrode 316 and bottom electrode 318 forming a piezoelectric structure which may be included in a deformable structure 304. Note that the term deformable structure generally refers to any structure that may deform in response to an external phenomenon such as a pressure or an acceleration. The deformable structure may comprise multiple elements or members including taught or tensioned membranes. A deformable structure may be, or include elements that may be, completely supported along a perimeter (e.g., such as a diaphragm). A deformable structure may also be, or include elements that may be, not completely supported along at least one side of a perimeter (e.g., such as a cantilever beam).

The deformable structure 304 may be disposed on, and in some embodiments, electrically isolated from, backplate 306, which may be disposed on a base 320 as shown. The deformable structure may include the piezoelectric structure (i.e., at least one of electrodes 316 and 318 and piezoelectric film 314), and in some embodiments, a deformable element which may also be a layer of piezoelectric film. Note that the term deformable element generally refers to an element or layer of a deformable structure that may deform in response to an external phenomenon such as a pressure or an acceleration. A deformable element may be a material such as silicon or may be a layer of piezoelectric material. A deformable element may be fully supported along its perimeter (e.g., a diaphragm) or may not be completely supported along at least one side of its perimeter (e.g., a cantilever beam).

The microphone structure (deformable structure 304, backplate 306, and base 320) may be disposed on a substrate such as PCB 310. PCB 310 may include a sound inlet, such as inlet hole 312, and a processing element (or functional unit), such as ASIC 308, may be disposed on PCB 310 and electrically coupled to the deformable structure. A lid 314 may also be disposed on PCB 310. Note that a processing element (or functional unit) refers to various elements or combinations of elements. Processing elements include, for example, circuits such as an ASIC (Application Specific Integrated Circuit), portions or circuits of individual processor cores, entire processor cores, individual processors, programmable hardware devices such as a field programmable gate array (FPGA), and/or larger portions of systems that include multiple processors, as well as any combinations thereof.

Additionally, in some embodiments the substrate may include a programmable hardware element that may include various hardware devices comprising multiple programmable function blocks connected via a programmable interconnect. Examples include FPGAs (Field Programmable Gate Arrays), PLDs (Programmable Logic Devices), FPOAs (Field Programmable Object Arrays), and CPLDs (Complex PLDs). The programmable function blocks may range from fine grained (combinatorial logic or look up tables) to coarse grained (arithmetic logic units or processor cores). A programmable hardware element may also be referred to as "reconfigurable logic".

Note that piezoelectric materials are a special class of materials that may produce an electrical signal when flexed or strained (i.e., sensing configuration), and/or produce a force or strain when an electrical signal is applied (i.e., actuator configuration). As illustrated in FIG. 3, the microphone structure may have both capacitive sensing and piezoelectric actuation.

In some embodiments, a multi-mode capacitive microphone may include at least three electrodes. The at least three electrodes may include at least one stationary electrode (i.e., an electrode disposed on a stationary portion of the microphone) and at least two electrodes disposed on or included in a deformable structure. The at least two electrodes may be configured to actuate a piezoelectric film included in the deformable structure. Additionally, the at least one stationary electrode may be configured as a primary electrode of a variable capacitor and one of the at least two electrodes may be configured as a secondary electrode of the variable capacitor. Thus, as described above, FIG. 3 illustrates one possible embodiment in which piezoelectric film 314 may be disposed between electrodes 316 and 318 where electrodes 316 and 318 are configured to actuate piezoelectric film 314. Additionally, backplate 306 may be configured as a primary electrode of a variable capacitor and one of electrodes 316 and 318 may be configured as a secondary electrode of the variable capacitor. Note that each electrode may be electrically coupled to a processing element (or functional unit) such as ASIC 308 and multi-mode microphone 300 may have both capacitive sensing and piezoelectric actuation of the deformable structure.

Hence, the above described structure may allow for multiple operating modalities to be enabled. For example, in one embodiment, a multi-mode microphone may have force feedback (e.g., via electrodes 316 and 318 and piezoelectric film 314) and motion of the deformable structure may be sensed capacitively (e.g., via one of electrodes 316 and 318 and backplate 306) and the measured motion signal may be processed (e.g., via a processing element such as ASIC 308) to result in a desired actuation signal being applied back to the deformable structure (e.g., via actuation of the piezoelectric film via electrodes 316 and 318). Additionally, many types of control architectures may be possible, including proportional, integral, and derivative (PID) control of deformable structure motion. In one embodiment, a feedback algorithm may operate such that an applied piezoelectric force opposes acoustic force. This may minimize deformable structure motion in response to acoustic force. Force rebalance schemes may minimize the deformable structure motion allowing the capacitive sensing scheme to remain linear and free of distortion that typically results from large deformable structure motion.

Figure 4A:
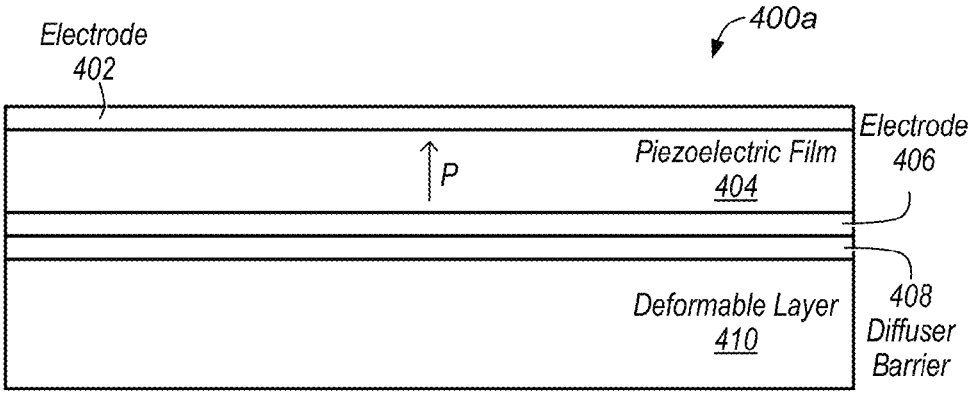
FIGS. 4A-4C illustrate deformable structure configurations according to embodiments.
Figure 4B:
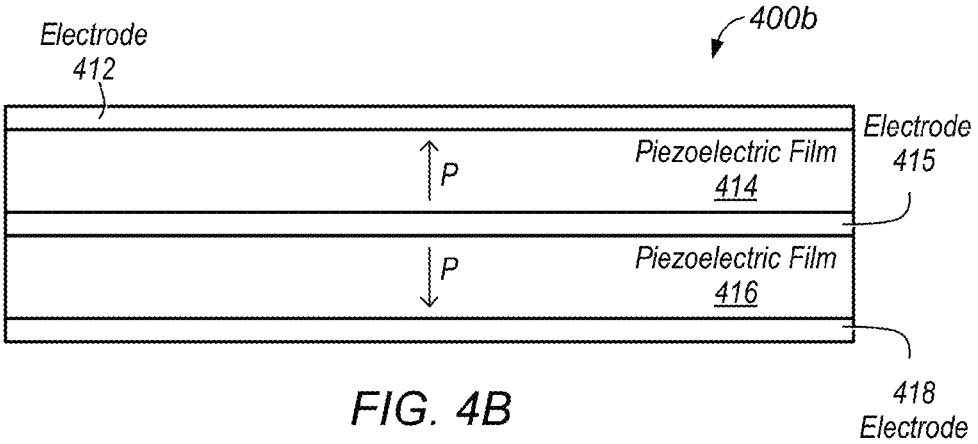
Figure 4C:
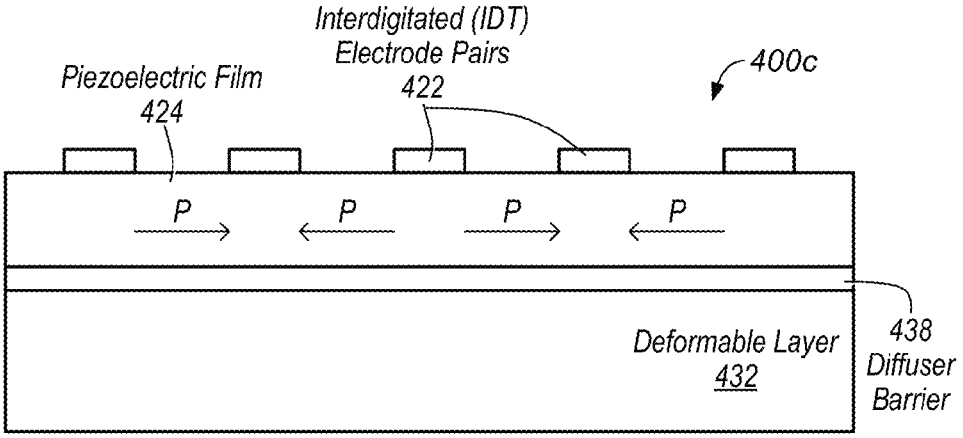

FIGS. 4A-4C illustrate deformable structure configurations according to embodiments. Note that the deformable structures illustrated in FIGS. 4A-4C may be combined with any of a variety of deformation sensing schemes, such as the capacitive sensing schemes described above in reference to FIG. 3 and below in reference to FIGS. 5A-C. In addition, the deformable structures illustrated in FIGS. 4A-4C may be combined with optical sensing schemes and piezoelectric sensing schemes described below in reference to FIGS. 6-11B.

FIG. 4A illustrates unimorph deformable structure configuration 400*a* according to one embodiment. Unimorph deformable structure configuration 400*a* may be a multi-layer structure that may include at least a top electrode 402 and a piezoelectric film 404. The top electrode may be an actuator port. In addition, the multi-layer structure may include a bottom electrode 406 and a deformable layer 410. The piezoelectric film 404 may be disposed between top electrode 402 and bottom electrode 406. Deformable layer 410 may be a deformable material such as silicon or polysilicon. In some embodiments, unimorph deformable structure 400*a* may also include a diffusion barrier 408 that may prevent diffusion of elements from piezoelectric film 404 into deformable layer 410 during high-temperature fabrication steps. Electrodes 402 and 406 may be configured to actuate piezoelectric film 404 (i.e., the electrodes may form at least one actuator port configured to generate an electrical fields within the piezoelectric material). In one embodiment, either of the electrodes may be configured as a movable electrode of a variable capacitor as described above. In other embodiments, deformable layer 410 may be configured as a movable electrode of a variable capacitor. In other words, one of electrodes 402 and 406, configured to actuate the piezoelectric film, may also be configured as a secondary electrode of a variable capacitor. Alternatively, an additional electrode, such as an electrically conductive deformable layer, may be configured as a secondary electrode of the variable capacitor.

In some embodiments, electrodes 402 and 406 may be patterned in complex shapes to realize complex actuation behavior. In other words, the placement and design of electrodes 402 and 406 may be configured based on a desired deformation shape of the deformable structure. Thus, such a technique may be used to tailor-design a deformation shape of the deformable structure when an electrical signal is applied to the piezoelectric film. Further, some embodiments may include multiple independent actuation ports. The multiple independent actuation ports may be realized by selectively patterning top and bottom electrode layers to further enhance the control of the deformable structure's deformation profile (shape) via application of electrical signals to the piezoelectric film via the actuator ports.

FIG. 4B illustrates a bimorph deformable structure configuration 400*b* according to one embodiment. In such embodiments, multiple (i.e., at least two or a plurality) layers of piezoelectric material may be used to form the deformable structure. For example, as illustrated in FIG. 4B, bimorph deformable structure configuration 400*b* may include an electrode 412 disposed on a top side of piezoelectric film 414. Another electrode 415 may be disposed on a bottom side of piezoelectric film 414 and the top side of piezoelectric film 416. Additionally, electrode 418 may be disposed on a bottom side of piezoelectric film 416. In other words, the bimorph deformable structure configuration 400*b* may include a layer stack of a top electrode (e.g., electrode 412), a first layer of piezoelectric material (e.g., piezoelectric film 414), a middle electrode (e.g., electrode 415), a second layer of piezoelectric material (e.g., piezoelectric film 416), and a bottom electrode (e.g., electrode 418). In one embodiment, electrodes 412, 415, and 418 may be configured to actuate piezoelectric films 414 and 416 (i.e., the electrodes may be actuator ports). Note that any of electrodes 412, 415, 418 may also be configured as a movable (i.e., secondary) electrode of a variable capacitor. In some embodiments, electrodes 412, 415, 418 may be electrode layers and each electrode layer may include a plurality of electrodes that may form multiple actuation ports. In such embodiments, each electrode layer may be configured to form electrode pairs. Thus, electrodes of a top electrode layer may form electrode pairs with all or a subset (i.e., portion) of the electrodes of a middle electrode layer. Additionally, electrodes of a bottom electrode layer may form electrode pairs with all or a subset (i.e., portion) of the electrodes of the middle electrode layer. The electrode pairs may be configured to form independent actuator ports of the deformable structure and further enhance the control of the deformable structure's deformation profile (shape) via application of the electrical signal to the actuator ports.

FIGS. 4A and 4B illustrate a parallel-plate electrode mode which results in a 3-1 mode of piezoelectric transduction. In a 3-1 mode of piezoelectric transduction, the piezoelectric film may have a polarization vector ("P") oriented approximately vertically and vertically applied electrical fields may induce lateral strain that deforms the deformable structure.

FIG. 4C, however, illustrates interdigitated (IDT) electrode deformable structure configuration 400*c* with a 3-3 mode of piezoelectric transduction according to embodiments. IDT electrode deformable structure 400*c* may include a plurality of IDT electrode pairs 422 disposed on a first surface of a piezoelectric film 424. Piezoelectric film 424 may be disposed on a diffusion barrier 438 which separates piezoelectric film 424 from deformable layer 432. In such embodiments, IDT electrodes 422 may be configured to induce polarization vectors (P) within piezoelectric film 424. In other words, applying electrical signals to an IDT electrode pair may induce lateral strain in piezoelectric film 424 that deforms the deformable structure. Any IDT electrode may also be configured as a movable (i.e., secondary) electrode of a variable capacitor. Alternatively, in some embodiments, deformable layer 432 may be electrically conductive and configured as the movable (i.e., secondary) electrode of the variable capacitor. Note that in one embodiment, IDT electrode deformable structure 400*c* may not include deformable layer 432. In other words, the IDT electrode deformable structure may include electrodes (i.e., actuator ports) 422 and a piezoelectric film.

Figure 5A:
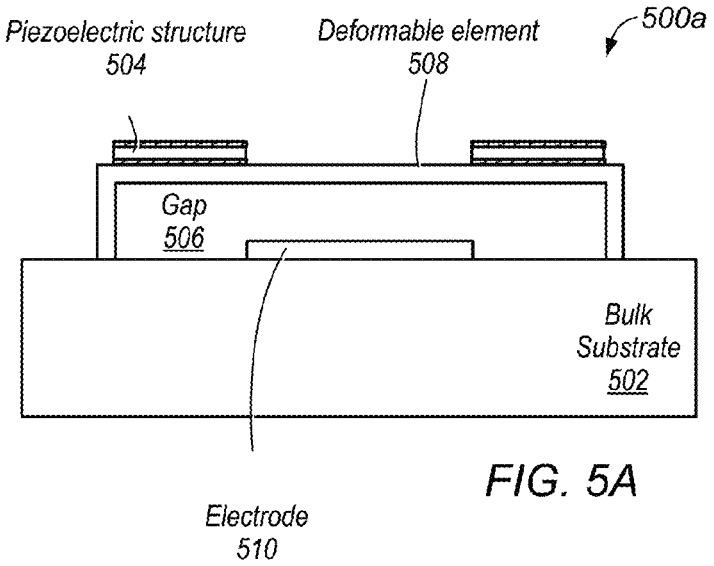
FIGS. 5A-5C illustrate multi-mode microphones according to embodiments.
Figure 5B:
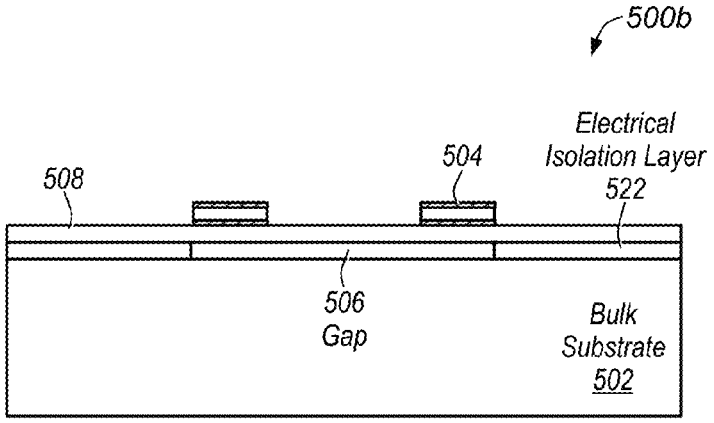
Figure 5C:
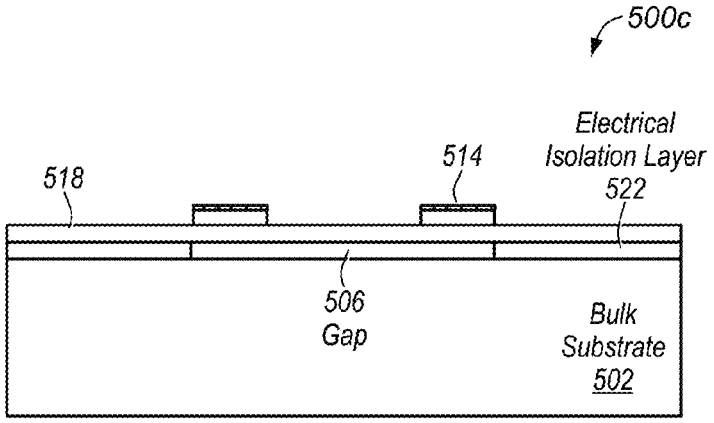

FIGS. 5A-5C illustrate multi-mode microphones according to embodiments. Note that whereas FIG. 3 illustrates a sensor (i.e., microphone) configuration that may include a deep reactive-ion etch (DRIE) through a silicon base and a perforated backplate configured as the stationary (i.e., primary) electrode of a variable capacitor, FIGS. 5A-5C illustrate embodiments of a sensor without a DRIE through a silicon base and a perforated backplate. Note that broadband microphones and ultrasonic transducers may be realized using embodiments illustrated in FIGS. 5A-5C. As shown, multi-mode microphone 500*a* may include a deformable element 508 and back-volume (i.e., gap 506) may be formed via surface-micromachining processes. Thus, deformable element 508 and stationary (i.e., primary) electrode 510 (of a variable capacitor) may be fabricated against a solid surface of bulk substrate 502. Piezoelectric structure 504 (as described above) may be disposed on a surface of deformable element 508 opposite gap 506. In some embodiments, gap 506 may be sealed under vacuum or with a reduced pressure lower than atmospheric pressure to control device dynamics, reduce air-damping (i.e., squeeze-film damping), and thereby lower thermal-mechanical noise. As described above, one of the electrodes (top or bottom) of the piezoelectric structure may be configured as the movable (i.e., secondary) electrode of the variable capacitor. Additionally, the top and bottom electrodes of the piezoelectric structure may be configured to actuate the piezoelectric film to control the deformation of the deformable structure. In one embodiment, deformable element 508 may be an electrically conductive material such as doped epitaxial silicon and may be configured as the movable (i.e., secondary) electrode of the variable capacitor.

FIGS. 5B and 5C illustrate further embodiments of multi-mode microphone 500*a*. For example, multi-mode microphone 500*b*, illustrated in FIG. 5B, may include piezoelectric structure 504 as described above and a deformable element 508 as described above. Piezoelectric structure 504 may be disposed on deformable element 508 to form a deformable structure. The deformable structure may be disposed on electrical isolation layer 522 which, in turn, may be disposed on bulk substrate 502. In one embodiment, a silicon-on-insulator (SOI) wafer may be configured as deformable element 508 (i.e. the epitaxial silicon layer), electrical isolation layer 522 (insulator, e.g., silicon dioxide), and bulk substrate 502 (silicon). Additionally, bulk substrate 502 may be configured as a stationary (i.e., primary) electrode of a variable capacitor and one of the electrodes of piezoelectric structure 504 may be a movable (i.e., secondary) electrode of the variable capacitor.

As another example, multi-mode microphone 500*c*, illustrated in FIG. 5C, may include piezoelectric structure 514 disposed on deformable element 518 to form a deformable structure. As shown, piezoelectric structure 514 may include an electrode disposed on a piezoelectric film. Additionally, deformable element 518 may be, or include, a piezoelectric material, or may be electrically conductive and configured as a shared electrode. In other words, deformable element 518 may be configured as an electrode for actuation of the piezoelectric film and may also be configured as an electrode for capacitive displacement measurement of the deformable structure (i.e., a secondary electrode of a variable capacitor). The deformable structure may be disposed on electrical isolation layer 522 and bulk substrate 502 as described above in reference to FIG. 5B. Note that in one embodiment, the deformable structure may be an epitaxial-silicon layer containing (i.e., including) a piezoelectric film.

As discussed above, two relevant metrics for MEMS microphones are noise floor or minimum detectable pressure (MDP), and dynamic range (DR) or acoustic overload pressure (AOP). The above described embodiments may provide a means to increase DR as well as sensitivity and noise floor. For example, in one embodiment, capacitively sensing motion of a deformable structure may provide means for force feedback and the measured motion signal may be processed to result in a desired actuation signal applied back to the deformable structure. Further, in embodiments, a plurality of control architectures may be implemented, including proportional, integral, and derivative (PID) control of the motion of the deformable structure. In one embodiment, a feedback algorithm may be configured such that an applied piezoelectric force opposes acoustic force, thereby minimizing deformable structure motion in response to acoustic force. In other words, embodiments may provide means for a force rebalance algorithm that may minimize deformable structure motion in response to acoustic force. In one embodiment, motion of a deformable element of the deformable structure may be minimized in response to an acoustic force applied to the deformable element (e.g., a closed-loop, force feedback microphone in which dynamic forces may be applied to the deformable element of the deformable structure (via the piezoelectric film). Note that such force rebalance algorithms may provide means for maintaining a linear and distortion free capacitive sensing scheme as compared to capacitive sensing schemes involving larger deformable structure motion. In one embodiment, a signal applied to the deformable structure may also be a microphone output signal.

Note further that embodiments in which the electrical signal applied to the deformable structure is in direct proportion to the deformable structure's motion is one of many possible embodiments. The measured deformable structure motion signal may be processed in any number of ways before being applied back to the deformable structure's piezoelectric actuation port to further increase linearity of the microphone sensor system or alter a frequency response of the microphone sensor system.

In addition to providing a means to increase DR, embodiments may also provide means to improve microphone sensitivity and signal-to-noise ratio (SNR). In the prior art, capacitively-sensed microphones may require that a static or DC bias voltage be applied across a variable capacitor to enable capacitance changes (and therefore deformable structure motion) to be detected. In capacitive sensing schemes, it is well known to those skilled in the art that sensitivity and signal-to-noise-ratio increase with increasing bias voltage. It also well known that, since the applied DC bias deflects the deformable structure towards the stationary electrode, the level of applied DC bias voltage may be limited to a value less than a bias that would pull the deformable structure into contact with the stationary electrode (so called "pull-in" voltage or "collapse" voltage). In contrast with the prior art, embodiments may provide means for a DC or static piezoelectric signals to be applied to the deformable structure such that the deformable structure may be forced away from the stationary electrode, and therefore, resist the deformable structure pull-in. In other words, the above described embodiments may provide means for applying bias voltages greater than a "pull-in" or "collapse" voltage.

FIG. 6 to FIG. 10: Multi-Mode Optical Microphone

Figure 6:
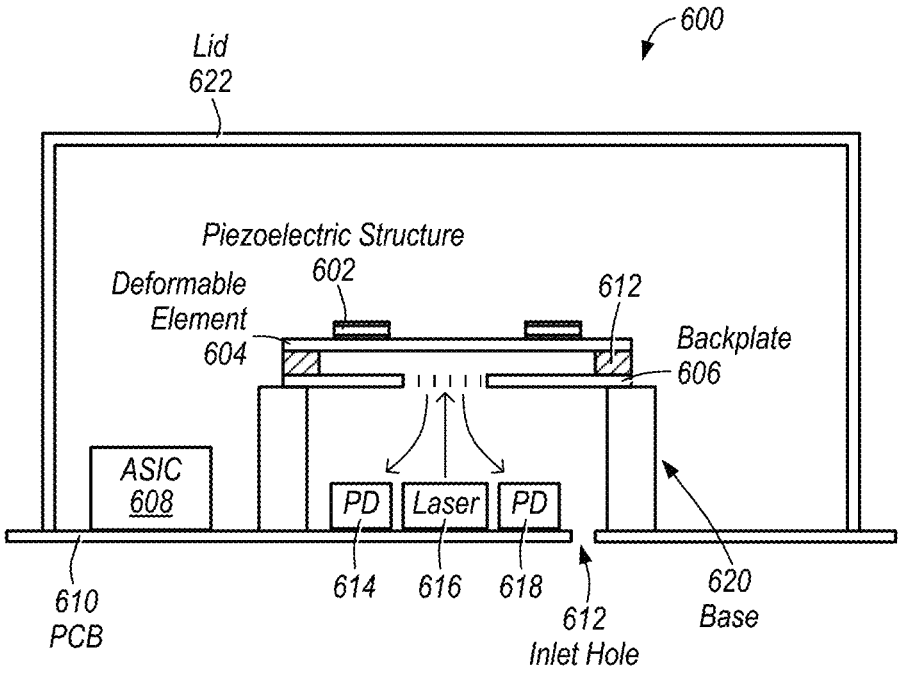
FIG. 6 illustrates a multi-mode microphone according to one embodiment.

FIG. 6 illustrates a multi-mode microphone 600 according to one embodiment. In such an embodiment, deformable structure motion (i.e., deformation or deflection of the deformable structure) may be sensed using interference of light waves and the deformable structure may be actuated using piezoelectric materials. As illustrated, multi-mode microphone 600 may include a piezoelectric structure 602 (i.e., a structure including a first electrode disposed on a first side of a piezoelectric film and a second electrode disposed on a second side of a piezoelectric film and opposite the first electrode), disposed on a deformable element 604 to form a deformable structure. The deformable structure may be supported by supports 612 which may be disposed on backplate 606. Backplate 606 may be configured as (or include) an optical beamsplitter and may be disposed on base 620. The base 620 may be disposed on a substrate such as PCB 610. Additionally, a processing element (or functional unit), such as ASIC 608, may be coupled to PCB 610 and further coupled to piezoelectric structure 602 via an electrical coupling. PCB 610 may also include an inlet hole 612. A lid 622 may be disposed on PCB 610. Additionally, multi-mode microphone 600 may include a light source, such as laser 616 and one or more light sensors, such as photo diodes (PD) 614 and 618.

As illustrated, backplate 606 may include an optical beamsplitter that may be positioned in proximity to the deformable structure and the optical beamsplitter and the deformable structure may be illuminated with light from a laser 616. In one embodiment, the optical beamsplitter may be a diffraction grating comprised of a portion of optically reflective regions and a portion of approximately transparent regions. The diffraction grating may allow a first portion of incident light to pass through and reflect off of the deformable structure (e.g. off of deformable element 604) while a second portion of incident light may be directly reflected by the grating. The portions of incident light combine and interfere and properties of a reflected field may depend on the spacing between the diffraction-grating plane and a layer or region of the deformable structure (e.g. deformable element 604). Thus, displacement of the deformable structure may be inferred via monitoring of the reflected field (e.g., via photodiodes 614 and 618). In other embodiments, the optical beamsplitter may be a semi-transparent mirror that may allow a first portion of incident light to pass through and reflect off of the deformable structure (e.g. off of deformable element 604).

Figure 7:
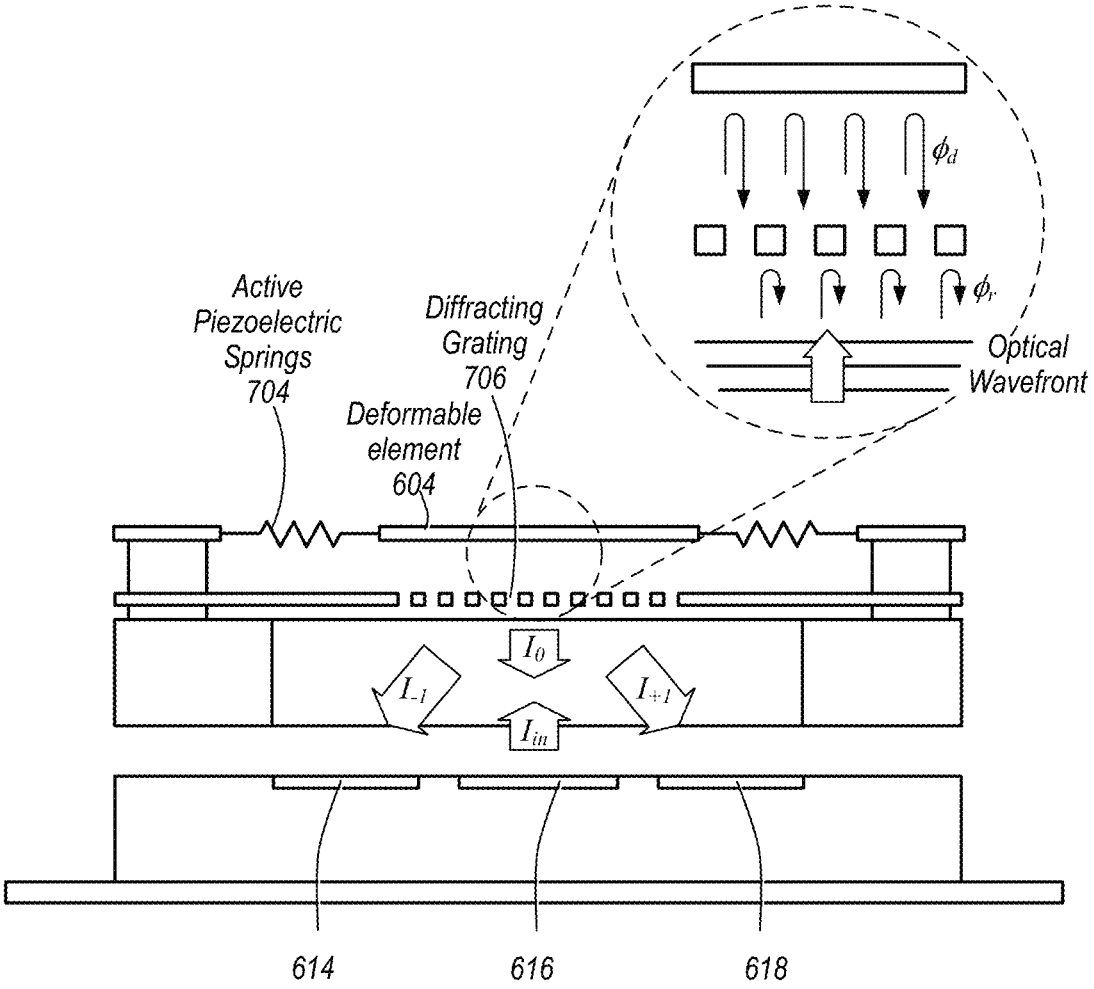
FIG. 7 illustrates an embodiment of an optical multi-mode microphone.

For example, as illustrated in FIG. 7, when sound pressure is applied to the deformable structure (e.g. to deformable element 604) it may deflect vertically relative to the approximately rigid diffracting grating 706 (e.g., the optical beamsplitter of backplate 606). Accordingly, when this system is illuminated with coherent light from the backside (e.g., via laser 616) as illustrated in FIG. 6, a portion of incident light reflects directly off of the grating fingers (i.e., reference fingers) while light in between the grating fingers travels to a layer or region of the deformable structure (e.g. deformable element 604) and back to accrue additional phase. The inset of FIG. 7 illustrates the interference physics occurring at the grating. Light reflecting from the grating provides a reference phase $\phi_r$, while light traveling to deformable element 604 and back returns with a phase $\phi_d=4\pi h/\lambda$, where $\lambda$ is the wavelength of the incident light and h is the spacing between deformable element 604 and diffraction grating 706. The diffraction grating thus may perform the function of an optical-beam splitter as stated previously. This particular system forms what is known as a phase-sensitive diffraction grating. The diffracted field that returns to the plane of the photodetectors consists of zero-and-higher orders whose angles remain fixed by the grating period, but whose intensities are modulated by the diaphragm displacement, h.

Similar to the capacitive embodiments described above in reference to FIGS. 3-5, optical embodiments provide means for closed-loop sensor operation which, in-turn, enables sensor DR improvement. Further, it may be advantageous to tune optical microphones such that the nominal gap height formed between the deformable structure and beamsplitter corresponds to a point of maximum sensitivity or maximum linearity. Thus, piezoelectric actuation (e.g., via active piezoelectric springs 704 or piezoelectric structure 602) of the deformable structure may provide means for tuning of this displacement via application of DC signals to actuation ports to statically deflect the deformable structure to a position of maximum sensitivity and linearity. In one embodiment, piezoelectric actuation of the deformable structure may remove the need for a backplate altogether, thereby removing mechanical damping typically introduced by a backplate. Note that lower damping implies lower levels of thermal-mechanical noise. Additionally, in embodiments that include a backplate (e.g., to hold a beamsplitter in proximity to the deformable structure), piezoelectric actuation of the deformable structure may provide means for arbitrary gap spacing between the backplate and the deformable structure since the backplate is no longer required to be utilized for electrostatic actuation.

Figure 8:
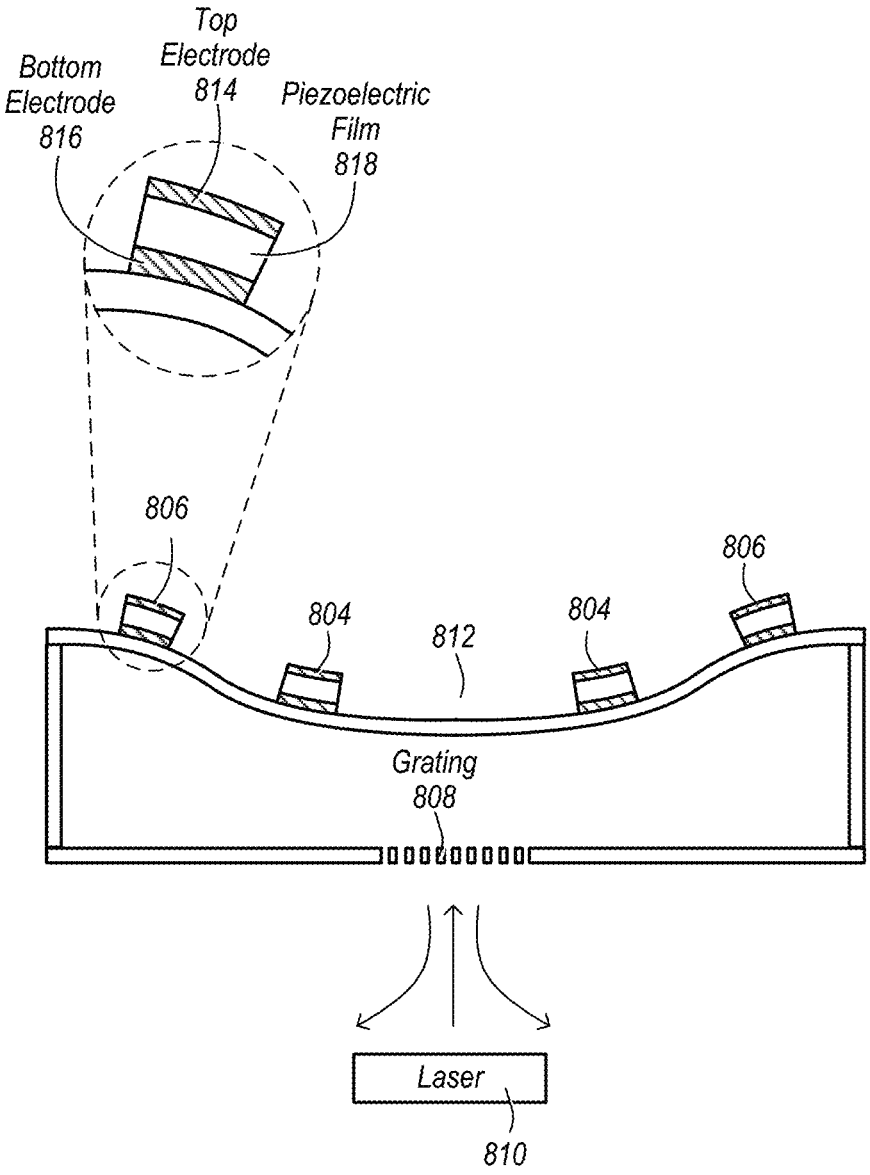
FIG. 8 illustrates another embodiment of an optical multi-mode microphone that includes multiple ring electrodes.

FIG. 8 illustrates one embodiment of an optical multi-mode microphone. As shown, an optical multi-mode microphone may include inner piezoelectric structure 804 and outer piezoelectric structure 806. Each piezoelectric structure may be similar to the piezoelectric structures described above. Thus, piezoelectric structure 806 may each include a top and bottom electrode (814 and 816, respectively) and a piezoelectric film 818 disposed between the electrodes. Piezoelectric structure 804 may have a similar configuration. Piezoelectric structures 804 and 806 may be included in deformable structure 812. In addition, the optical multi-mode microphone may include laser 810 and grating 808.

Note that other embodiments of optical multi-mode microphones are envisioned that may incorporate any of the deformable structure configurations described above in reference to FIGS. 4A-4C. In such cases the laser light may be configured to reflect from any one or several of the various layers comprising the deformable structure. Additionally, multiple actuation ports may be configured via multiple sets of electrodes. In the illustrated embodiment, two independent sets of electrodes (i.e., the electrodes of piezoelectric structures 804 and 806) in the form of an inner and outer ring are configured to actuate the piezoelectric material of piezoelectric structures 804 and 806. Note that for optical systems in particular, it may be desirable to have a flat reflecting region of the deformable structure. Multiple electrodes may enable this as the outer electrode may bend the deformable structure downward when an electrical signal is applied, and the inner electrode may tend to bend the center region of the deformable structure back upward as illustrated. This is possible since the polarity of the electrical signal determines the upward vs. downward nature of the deflection, and different polarities may be applied to inner and outer electrodes.

Figure 9:
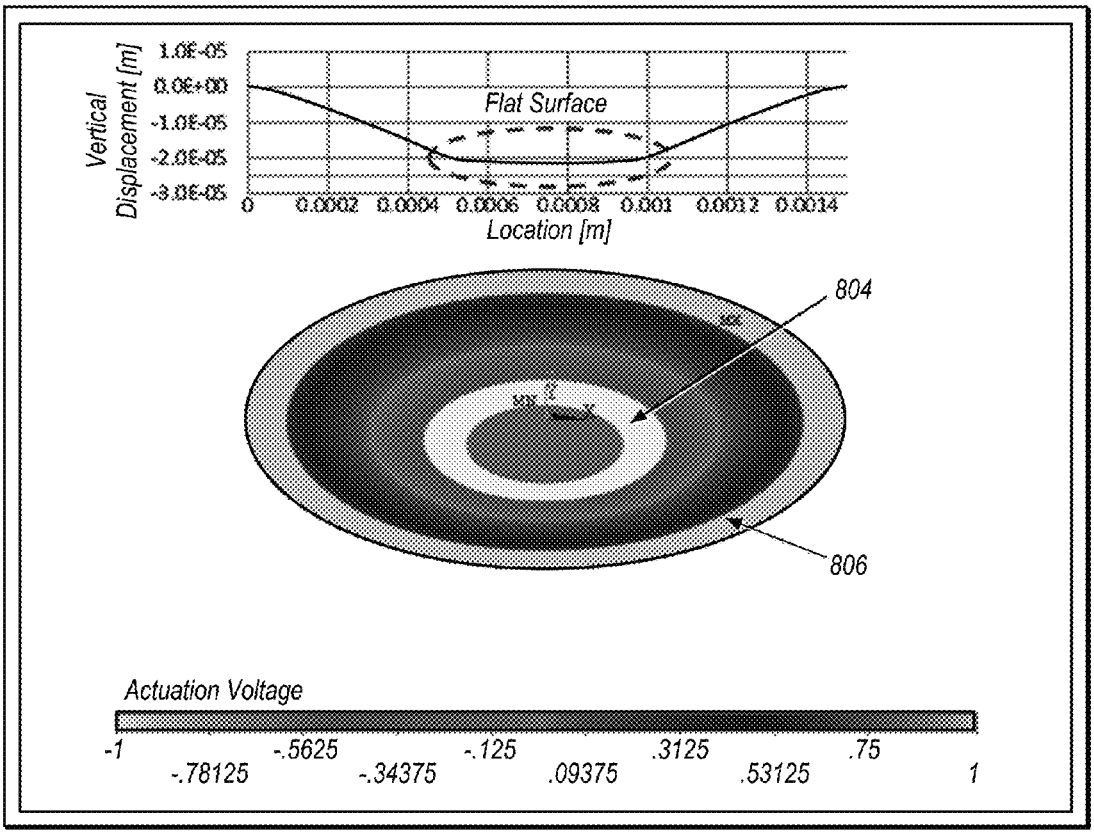
FIG. 9 illustrates an FEA result of a dual-electrode diaphragm as illustrated in FIG. 8.

FIG. 9 illustrates an FEA result of a dual-electrode diaphragm, such as the embodiment illustrated in FIG. 8. The deformation shape is simulated to show the feasibility of producing an approximate flat region of deflection near the center.

Figure 10A:
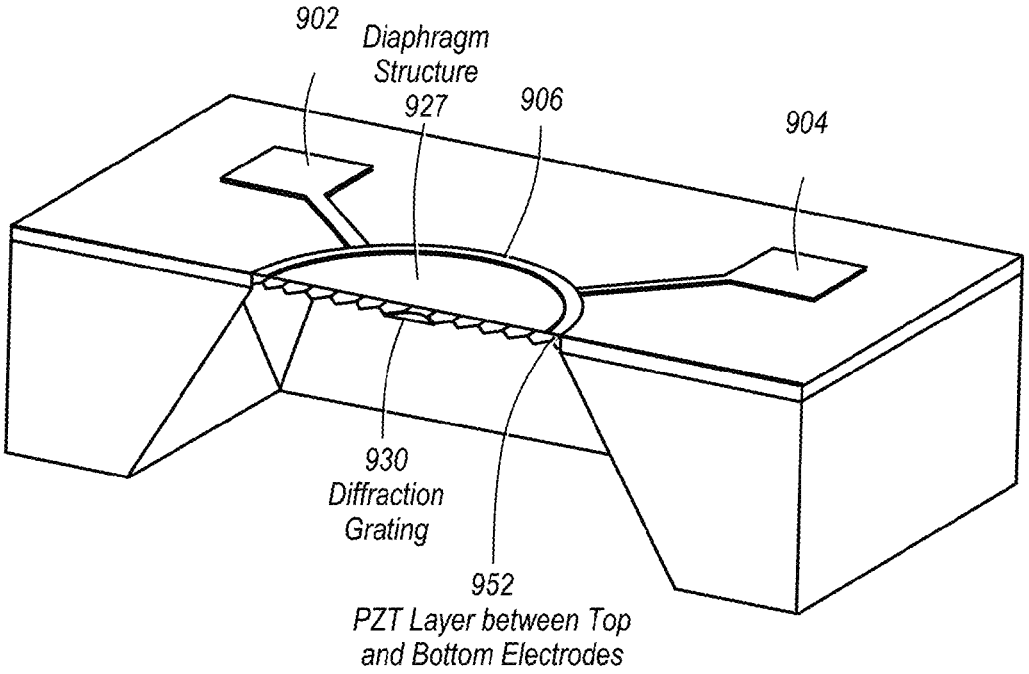
FIGS. 10A-10C illustrate one embodiment of an optical multi-mode microphone that includes a single outer-ring electrode.
Figure 10B:
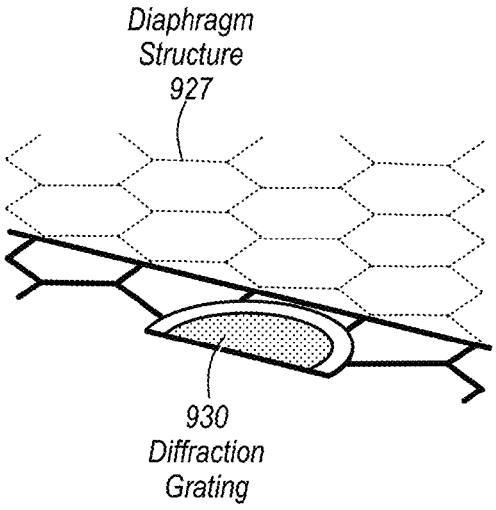
Figure 10C:
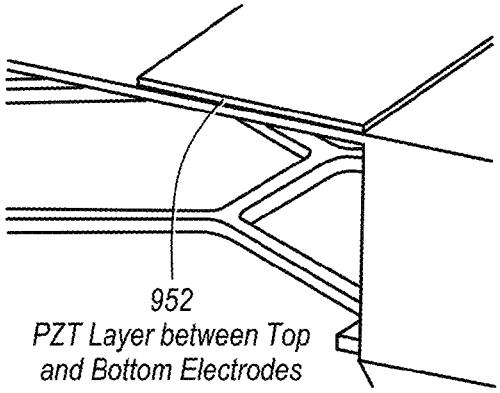

FIGS. 10A-10C illustrate one embodiment of an optical multi-mode microphone that includes a single outer-ring electrode. As illustrated, a single outer-ring piezoelectric structure 906 (with electrodes and electrode bondpads 902 and 904) may be integrated into deformable structure 927 of a diffraction-based optical microphone. Diffraction grating 930 may be proximate to deformable structure 927. FIG. 10B illustrates a magnified view of diffraction grating 930 and FIG. 10C illustrates a magnified view of a piezoelectric (e.g. PZT) layer 952 between top and bottom electrodes.

Note that intrinsic DR is defined as the difference between the loudest sound pressure level (SPL) that a microphone may detect linearly with less than 10% distortion, and the minimum detectable SPL (in dBA). Since sound pressure and displacement of the deformable structure are related through the deformable structure's compliance, the intrinsic DR of a given transduction scheme may also be analyzed in terms of displacement. In open-loop (i.e., prior art) microphones, the grating-based optical-readout scheme distorts 10% when the deformable structure displacement is ±100 nm in amplitude. Considering that 1-pm A-weighted deformable structure displacement can be resolved, the intrinsic DR is 98 dB (i.e., 20 $\log_{10}$(100 nm/1 pm)=98 dB). Assuming the 98-dB intrinsic DR, the implication is that a microphone with 10-dBA noise floor will distort at 108-dB SPL. Thus, for the open-loop optical microphone, a compromise in maximum SPL is made to achieve the ultra-low noise performance. However, according to embodiments, deformable structure displacement signals may be used to immediately apply counterbalancing pressures through use of the internal piezoelectric actuator. The internal pressure may hold the deformable structure nearly motionless about an operating point (and well-within the linear displacement range of the readout scheme) thereby avoiding a compromise in maximum SPL to achieve ultra-low noise performance.

Although embodiments have been described in terms of diffraction-based optical-readout techniques, it should be noted that other implementations of optical interferometers are possible, including Fabry-Perot systems where the beamsplitter is comprised of a semitransparent mirror.

Figure 11A:
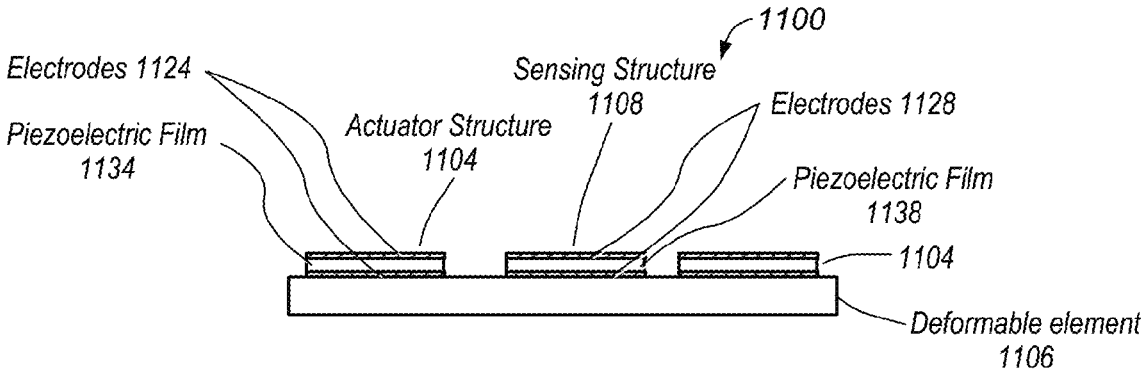
FIGS. 11A-B illustrate a multi-mode microphone according to an embodiment.
Figure 11B:
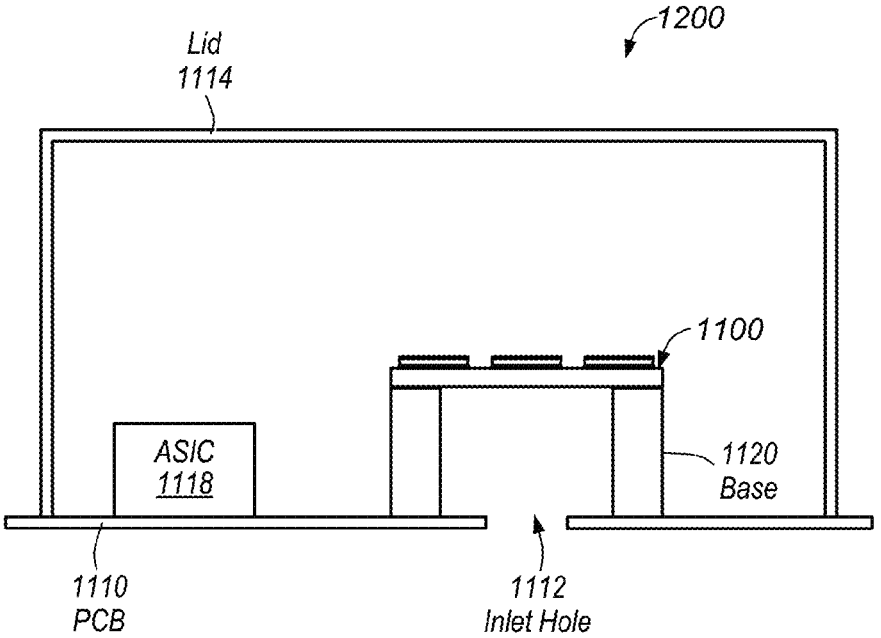

FIGS. 11A-B: Multi-Mode Sensing Port Microphone

FIGS. 11A-B illustrate a multi-mode microphone system according to one embodiment, illustrating a class of embodiments in which piezoelectric materials comprised in, or disposed on, the deformable structure are used to sense the motion of the deformable structure, and piezoelectric materials comprised in, or disposed on, the deformable structure are used to actuate the deformable structure. Note that the embodiments described in reference to FIGS. 11A-B may be used in combination with any of the deformable structure configurations described above in reference to FIGS. 4A-C, among other deformable structure configurations. As shown in FIG. 11A, a multi-mode microphone may include a deformable structure 1100 which may include an actuator structure 1104 that may include at least one piezoelectric layer, such as piezoelectric film 1134, and at least one electrode pair, such as electrodes 1124. Multi-mode microphone 1100 may also include a sensing structure 1108 that may include at least one piezoelectric layer, such as piezoelectric film 1138, and at least one electrode pair, such as electrodes 1128. Actuator structure 1104 and sensor structure 1108 may each be disposed on a deformable element 1106. Sensor structure 1108 may be in contact with, or coupled to, a region of the deformable structure as shown.

Actuator structure 1104 and sensor structure 1108 may include the same layer of piezoelectric film and each structure may include a discrete portion of the layer of piezoelectric film. Deformable element 1106 may be comprised entirely of piezoelectric material or may include at least one layer of piezoelectric material.

As shown, sensing structure 1108 is in contact with (or coupled to) a region of deformable element 1106. Sensing structure 1108 may be configured to sense deformation of the deformable structure, and in response, generate a signal that may be used by a sensing element to detect deformation of the deformable structure. In one embodiment, the sensing element may include an integrated circuit that is included in a silicon chip or a substrate. Additionally, the sensing element may be electrically coupled to both the actuator structure and the sensing structure. Thus, the electrical signal applied via the actuator port may be based on the signal received from the sensing port.

As shown, sensing structure 1108 may include an electrode pair (electrodes 1128) and the electrode pair may sense deformation of a piezoelectric layer (piezoelectric film 1138) included in the deformable structure. In one embodiment, the sensing structure may include a pair of parallel plate electrodes. In another embodiment, the sensing structure may include a pair of interdigitated electrodes.

FIG. 11B illustrates a multi-mode microphone system according to embodiments. As shown, multi-mode microphone system 1200 may include a substrate, such as PCB 1110, a processing element, such as ASIC 1118, a lid 1114, a deformable structure 1100 as described above, and a base, such as base 1120. As shown PCB 1110 may include an inlet hole 1112. In one embodiment, the processing element, e.g., ASIC 1118, may be configured to detect deformation of deformable structure 1100 via a signal generated by at least one sensing port (e.g., a sensing port of sensing structure 1108) and transmit the electrical signal to an actuator port (e.g., an actuator port of actuator structure 1104). Thus, the processing element may actuate piezoelectric material to generate a force that is responsive to a sensed deformation of piezoelectric material. Such microphone embodiments may be useful for implementing closed-loop sensing modalities. In particular, many prior-art piezoelectric microphones are void of a backplate and therefore have inherently low viscous damping, which may produce an undesirable peak in the frequency response of the microphone. Applying signals to the actuator ports in proportion to the deformable structure's velocity and with opposing polarity can act to actively dampen the deformable structure motion, and reduce undesirable peaks in the frequency response.

Further Embodiments

In one embodiment, a sensor system may include a deformable structure and a sensing element. The deformable structure may include at least one layer of piezoelectric material and at least one actuator port disposed on the at least one layer of piezoelectric material. The at least one actuator port may be configured to actuate the at least one layer of piezoelectric material via application of an electrical signal to the at least one layer of piezoelectric material. The at least one layer of piezoelectric material may be configured to apply a force to the deformable structure when actuated. The sensing element may be configured to sense deformation of the deformable structure.

In any of the above described embodiments, the deformable structure may be approximately circular in shape and the at least one actuator port may be patterned in a shape of a single annular ring. Alternatively, a plurality of actuator ports may be patterned in a shape of two annular rings. In such embodiments, the two annular rings may be configured to deform the deformable structure such that an approximately flat profile exists at a center of the deformable structure.

In any of the above described embodiments, the deformable structure may further include a plurality of actuator ports and each of the plurality of actuator ports may include an electrode pair. In such embodiments, the plurality of actuator ports may be configured to deform the deformable structure via application of electrical signals to the at least one piezoelectric layer. Further, the deformable structure may have a deflection profile with an approximately flat center region.

In any of the above described embodiments, the deformable structure may further include at least one pair of parallel plate electrodes and the at least one layer of piezoelectric material may be actuated via the at least one pair of parallel plate electrodes. Additionally, in any of the above described embodiments, the deformable structure may further include at least one pair of interdigitated electrodes and the at least one layer of piezoelectric material is actuated via the at least one pair of interdigitated electrodes.

In any of the above described embodiments, the deformable structure may be configured to deform in response to one or more of an external acoustic pressure or an acceleration.

In any of the above described embodiments, the sensor system may include a variable capacitor and the variable capacitor may include a reference electrode and an electrode disposed on or comprised in the deformable structure and the sensing element may be configured to detect a capacitance change with respect to the reference electrode during deformation of the deformable structure. In some embodiments, a first bias voltage may be applied across the variable capacitor and a second bias voltage may be applied to the at least one layer of piezoelectric material to resist deformation of the deformable structure towards the reference electrode. Additionally, the at least one layer of piezoelectric material may be further configured to deform the deformable structure in a direction opposite the reference electrode when actuated via the at least one actuator port. Further, the sensor system may include a cavity between the deformable structure and the reference electrode and the cavity may be sealed under reduced pressure or vacuum. In one embodiment, the electrical signal applied to the at least one layer of piezoelectric material may be based on a measured capacitance change between the electrode disposed on or comprised in the deformable structure and the reference electrode.

In any of the above described embodiments, the sensor system may include an optical sensing element which may include a light source, a beamsplitter, and an optical sensor. In such embodiments, to sense deformation of the deformable structure, the sensing element may be further configured to sense deformation of the deformable structure based on interference of light. Additionally, the beamsplitter may include a diffraction grating that may be configured to reflect a first portion of incident light from the light source while allowing a second portion of incident light to pass through to the deformable structure. In addition, the electrical signal applied to the at least one layer of piezoelectric material may be based on the sensed deformation of the deformable structure based on interference of light.

In any of the above described embodiments, the sensor system may include at least one sensing port which may be configured to sense a deformation of a region of the deformable structure and generate a signal in response to the deformation. The at least one sensing port may be in contact with or coupled to the region of the deformable structure. Additionally, a sensing element may be configured to detect deformation of the deformable structure via the signal generated by the at least one sensing port.

In one embodiment, a multi-mode microphone system may include a substrate (e.g., a printed circuit board (PCB)), a multi-mode microphone coupled to the substrate, and a processing element electrically coupled to the substrate and multi-mode microphone. The substrate may include at least one sound inlet. The multi-mode microphone may include a cavity as described above in any of the embodiments and a deformable structure as described above in any of the embodiments. The processing element may be configured to sense deformation of the deformable structure and provide the electrical signal to the at least one actuator port.

In one embodiment, the processing element may be further configured to detect a capacitance change with respect to a reference electrode during deformation of the deformable structure. In some embodiments, the processing element may be further configured to base the electrical signal applied to at least one layer of piezoelectric material on a measured capacitance change between an electrode disposed on or comprised in the deformable structure and the reference electrode as described above in embodiments. In other embodiments, the processing element may be further configured to sense deformation of the deformable structure based on interference of light according to the above described embodiments. In yet other embodiments, the processing element may be further configured to detect deformation of a deformable structure via a signal generated by at least one sensing port and the at least one sensing port may be in contact with or coupled to a region of the deformable structure. The at least one sensing port may be configured to generate a signal in response to the deformation.

In one embodiment, a method may include a processing element performing sensing deformation of a deformable structure as described in any of the above embodiments and in response to the sensing, applying an electrical signal to the at least one actuator port. In some embodiments, the sensing may include the processing element sensing a capacitance change of a variable capacitor as described above during deformation of the deformable structure. In other embodiments, the sensing may include the processing element performing sensing, via an optical sensing element as described above, deformation of the deformable structure based on interference of light.

In one embodiment, a sensor may include means for sensing deformation of a deformable structure as described in any of the above embodiments and in response to the sensing, means for applying an electrical signal to at least one actuator port. In some embodiments, the means for sensing may include means for detecting a capacitance change of a variable capacitor as described above during deformation of the deformable structure. In other embodiments, the means for sensing may include means for sensing, via an optical sensing element as described above, deformation of the deformable structure based on interference of light. In other embodiments, the means for sensing may include means for sensing the deformation via deformation of piezoelectric material.

Embodiments of the present disclosure may be realized in any of various forms. For example some embodiments may be realized as a computer-implemented method, a computer-readable memory medium, or a computer system. Other embodiments may be realized using one or more custom-designed hardware devices such as ASICs. Still other embodiments may be realized using one or more programmable hardware elements such as FPGAs.

In some embodiments, a non-transitory computer-readable memory medium may be configured so that it stores program instructions and/or data, where the program instructions, if executed by a computer system, cause the computer system to perform a method, e.g., any of a method embodiments described herein, or, any combination of the method embodiments described herein, or, any subset of any of the method embodiments described herein, or, any combination of such subsets.

In some embodiments, a computer program, if executed by a computer system, may cause the computer system to perform a method, e.g., any of a method embodiments described herein, or, any combination of the method embodiments described herein, or, any subset of any of the method embodiments described herein, or, any combination of such subsets.

In some embodiments, a device may be configured to include a processor (or a set of processors) and a memory medium, where the memory medium stores program instructions or a computer program, where the processor is configured to read and execute the program instructions or computer program from the memory medium, where the program instructions are, or computer program is, executable to implement a method, e.g., any of the various method embodiments described herein (or, any combination of the method embodiments described herein, or, any subset of any of the method embodiments described herein, or, any combination of such subsets). The device may be realized in any of various forms.

Although the embodiments above have been described in considerable detail, numerous variations and modifications will become apparent to those skilled in the art once the above disclosure is fully appreciated. It is intended that the following claims be interpreted to embrace all such variations and modifications.

We claim:

1. A sensor system, comprising:

a deformable structure, wherein the deformable structure is subject to deformation in response to external phenomenon, wherein the deformable structure comprises:

at least one layer of piezoelectric material; and at least one actuator port disposed on the at least one layer of piezoelectric material, wherein the at least one actuator port is configured to actuate the at least one layer of piezoelectric material via application of an electrical signal to the at least one layer of piezoelectric material, wherein the at least one layer of piezoelectric material is configured to generate a force responsive to the electrical signal; and a sensing element, wherein the sensing element is configured to sense deformation of the deformable structure.

2. The sensor system of claim 1, wherein the deformable structure further comprises:

a deformable element, wherein the at least one layer of piezoelectric material is disposed on the deformable element.

3. The sensor system of claim 1, wherein the deformable structure further comprises:

at least one additional layer of piezoelectric material; and at least one additional actuator port disposed on the at least one additional layer of piezoelectric material, wherein the at least one additional actuator port is configured to actuate the at least one additional layer of piezoelectric material via application of an additional electrical signal to the at least one additional layer of piezoelectric material, wherein the at least one additional layer of piezoelectric material is configured to generate a force responsive to the additional electrical signal.

4. The sensor system of claim 1, wherein the deformable structure is approximately circular in shape, and wherein the at least one actuator port is patterned in a shape of a single annular ring.

5. The sensor system of claim 1, wherein the deformable structure further comprises a plurality of actuator ports, wherein each of the plurality of actuator ports comprises an electrode pair.

6. The sensor system of claim 5, wherein the plurality of actuator ports are configured to deform the deformable structure via application of electrical signals to the at least one piezoelectric layer.

7. The sensor system of claim 5, wherein the deformable structure is approximately circular in shape, and wherein the plurality of actuators ports is patterned in a shape of two annular rings.

8. The sensor system of claim 7, wherein the two annular rings are configured to deform the deformable structure such that an approximately flat profile exists at a center of the deformable structure.

9. The sensor system of claim 1, wherein the deformable structure has a deflection profile with an approximately flat center region.

10. The sensor system of claim 1, wherein the at least one actuator port comprises at least one pair of parallel plate electrodes, and wherein the at least one layer of piezoelectric material is actuated via the at least one pair of parallel plate electrodes.

11. The sensor system of claim 1, wherein the at least one actuator port comprises at least one pair of interdigitated electrodes, and wherein the at least one layer of piezoelectric material is actuated via the at least one pair of interdigitated electrodes.

12. The sensor system of claim 1, wherein the external phenomenon is an external acoustic pressure or an acceleration.

13. The sensor system of claim 1, further comprising a cavity between the deformable structure and a backplate.

14. The sensor system of claim 13, wherein the cavity is sealed under reduced pressure or vacuum.

15. A sensor system, comprising:

a deformable structure, wherein the deformable structure is subject to deformation in response to external phenomenon, wherein the deformable structure comprises:

at least one layer of piezoelectric material; and at least one actuator port disposed on the at least one layer of piezoelectric material, wherein the at least one actuator port is configured to actuate the at least one layer of piezoelectric material via application of an electrical signal to the at least one layer of piezoelectric material, wherein the at least one layer of piezoelectric material is configured to generate a force responsive to the electrical signal;

a variable capacitor, comprising:

a reference electrode; and an electrode comprised in the deformable structure, wherein a capacitance of the variable capacitor is based on deformation of the deformable structure; and a sensing element, wherein the sensing element is configured to detect deformation of the deformable structure via a change in capacitance of the variable capacitor.

16. The sensor system of claim 15, wherein a first bias voltage is applied across the variable capacitor, wherein a second bias voltage is applied to the at least one layer of piezoelectric material to resist deformation of the deformable structure towards the reference electrode.

17. The sensor system of claim 15, wherein the at least one layer of piezoelectric material is further configured to deform the deformable structure in a direction opposite the reference electrode when actuated via the at least one actuator port.

18. The sensor system of claim 15, wherein the electrical signal applied to the at least one layer of piezoelectric material is based on the change in capacitance of the variable capacitor.

19. The sensor system of claim 15, wherein the deformable structure further comprises:

a deformable element, wherein the at least one layer of piezoelectric material is disposed on the deformable element.

20. The sensor system of claim 15, wherein the deformable structure further comprises:

at least one additional layer of piezoelectric material; and at least one additional actuator port disposed on the at least one additional layer of piezoelectric material, wherein the at least one additional actuator port is configured to actuate the at least one additional layer of piezoelectric material via application of an electrical signal to the at least one additional layer of piezoelectric material, wherein the at least one additional layer of piezoelectric material is configured to generate a force responsive to the electrical signal.

21. The sensor system of claim 15, wherein the deformable structure is approximately circular in shape, and wherein the at least one actuator port is patterned in a shape of a single annular ring.

22. The sensor system of claim 15, wherein the deformable structure further comprises a plurality of actuator ports, wherein each of the plurality of actuator ports comprises an electrode pair.

23. The sensor system of claim 22, wherein the plurality of actuator ports are configured to deform the deformable structure via application of electrical signals to the at least one piezoelectric layer.

24. The sensor system of claim 22, wherein the deformable structure is approximately circular in shape, and wherein the plurality of actuator ports is patterned in a shape of two annular rings.

25. The sensor system of claim 24, wherein the two annular rings are configured to deform the deformable structure such that an approximately flat profile exists at a center of the deformable structure.

26. The sensor system of claim 15, wherein the at least one actuator port comprises at least one pair of parallel plate electrodes, and wherein the at least one layer of piezoelectric material is actuated via the at least one pair of parallel plate electrodes.

27. The sensor system of claim 15, wherein the at least one actuator port comprises at least one pair of interdigitated electrodes, and wherein the at least one layer of piezoelectric material is actuated via the at least one pair of interdigitated electrodes.

28. The sensor system of claim 15, wherein the at least one actuator port comprises the electrode comprised in the deformable structure.

29. The sensor system of claim 15, further comprising a cavity between the deformable structure and the reference electrode.

30. The sensor system of claim 29, wherein the cavity is sealed under reduced pressure or vacuum.

31. A multi-mode microphone system, comprising:
a substrate;
a multi-mode microphone coupled to the substrate, wherein the multi-mode microphone comprises:
a cavity;
a deformable structure, comprising:
at least one layer of piezoelectric material; and
at least one actuator port disposed on the at least one layer of piezoelectric material, wherein the at least one actuator port is configured to actuate the at least one layer of piezoelectric material via application of an electrical signal to the at least one layer of piezoelectric material, wherein the at least one layer of piezoelectric material is configured to generate a force responsive to the electrical signal; and
a processing element, electrically coupled to the substrate and multi-mode microphone, wherein the processing element is configured to:
sense deformation of the deformable structure; and
transmit the electrical signal to the at least one actuator port.

32. The multi-mode microphone system of claim 31, wherein the deformable structure further comprises a plurality of actuation ports, wherein each of the plurality of actuation ports comprises an electrode pair.

33. The multi-mode microphone system of claim 32 wherein the plurality of actuation ports are configured to deform the deformable structure via application of electrical signals to the at least one piezoelectric layer.

34. The multi-mode microphone system of claim 31, wherein the deformable structure further comprises at least one pair of parallel plate electrodes, and wherein the at least one layer of piezoelectric material is actuated via the at least one pair of parallel plate electrodes.

35. The multi-mode microphone system of claim 31, wherein the deformable structure further comprises at least one pair of interdigitated electrodes, and wherein the at least one layer of piezoelectric material is actuated via the at least one pair of interdigitated electrodes.

36. The multi-mode microphone system of claim 31, wherein the deformable structure further comprises:
a deformable element, wherein the at least one layer of piezoelectric material is disposed on the deformable element.

37. The multi-mode microphone system of claim 31, wherein the deformable structure further comprises:
at least one additional layer of piezoelectric material; and
at least one additional actuator port disposed on the at least one additional layer of piezoelectric material, wherein the at least one additional actuator port is configured to actuate the at least one additional layer of piezoelectric material via application of an additional electrical signal to the at least one additional layer of piezoelectric material, wherein the at least one additional layer of piezoelectric material is configured to generate a force responsive to the additional electrical signal; and
wherein the processing element is further configured to transmit the additional electrical signal to the at least one additional actuator port.

38. The multi-mode microphone system of claim 31, wherein the cavity is sealed under reduced pressure or vacuum.

39. A method comprising:
a processing element performing,
sensing deformation of a deformable structure, wherein the deformable structure comprises at least one layer of piezoelectric material and at least one actuator port disposed on the at least one layer of piezoelectric material, wherein the at least one actuator port is configured to actuate the at least one layer of piezoelectric material via application of an electrical signal to the at least one layer of piezoelectric material, wherein the at least one layer of piezoelectric material is configured to generate a force responsive to the electrical signal; and
in response to said sensing, applying the electrical signal to the at least one actuator port.

40. A multi-mode microphone system, comprising:
a substrate;
a multi-mode microphone coupled to the substrate, wherein the multi-mode microphone comprises:
a cavity;
a deformable structure, comprising:
at least one layer of piezoelectric material; and
at least one actuator port disposed on the at least one layer of piezoelectric material, wherein the at least one actuator port is configured to actuate the at least one layer of piezoelectric material via application of an electrical signal to the at least one layer of piezoelectric material, wherein the at least one layer of piezoelectric material is configured to generate a force responsive to the electrical signal; and
a variable capacitor, comprising:
a reference electrode; and
an electrode comprised in the deformable structure, wherein a capacitance of the variable capacitor is based on deformation of the deformable structure; and
a processing element, electrically coupled to the substrate and multi-mode microphone, wherein the processing element is configured to:
sense deformation of the deformable structure via a change in capacitance of the variable capacitor during deformation of the deformable structure; and
transmit the electrical signal to the at least one actuator port.

41. The multi-mode microphone system of claim 40, wherein the processing element is further configured to:
apply a bias voltage across the variable capacitor, wherein a first bias voltage is applied across the variable capacitor, wherein a second bias voltage is applied to the at least one layer of piezoelectric material to resist deformation of the deformable structure towards the reference electrode.

42. The multi-mode microphone system of claim 40, wherein the at least one layer of piezoelectric material is further configured to deform the deformable structure in a direction opposite the reference electrode when actuated via the at least one actuator port.

43. The multi-mode microphone system of claim 40, wherein the electrical signal applied to the at least one layer of piezoelectric material is based on the change in capacitance of the variable capacitor.

44. The multi-mode microphone system of claim 40, wherein the deformable structure further comprises a plurality of actuation ports, wherein each of the plurality of actuation ports comprises an electrode pair.

45. The multi-mode microphone system of claim 44, wherein the plurality of actuation ports are configured to deform the deformable element via application of electrical signals to the at least one piezoelectric layer.

46. The multi-mode microphone system of claim 40, wherein the deformable structure further comprises at least one pair of parallel plate electrodes, and wherein the at least one layer of piezoelectric material is actuated via the at least one pair of parallel plate electrodes.

47. The multi-mode microphone system of claim 40, wherein the deformable structure further comprises at least one pair of interdigitated electrodes, and wherein the at least one layer of piezoelectric material is actuated via the at least one pair of interdigitated electrodes.

48. The multi-mode microphone system of claim 40, wherein the deformable structure further comprises:

a deformable element, wherein the at least one layer of piezoelectric material is disposed on the deformable element.

49. The multi-mode microphone system of claim 40, wherein the deformable structure further comprises:

at least one additional layer of piezoelectric material; and at least one additional actuator port disposed on the at least one additional layer of piezoelectric material, wherein the at least one additional actuator port is configured to actuate the at least one additional layer of piezoelectric material via application of an additional electrical signal to the at least one additional layer of piezoelectric material, wherein the at least one additional layer of piezoelectric material is configured to generate a force responsive to the additional electrical signal; and wherein the processing element is further configured to transmit the additional electrical signal to the at least one additional actuator port.

50. A method comprising:

a processing element performing, sensing a change in capacitance of a variable capacitor during deformation of a deformable structure, wherein the variable capacitor comprises a reference electrode and an electrode comprised in the deformable structure, wherein the deformable structure comprises at least one layer of piezoelectric material and at least one actuator port disposed on the at least one layer of piezoelectric material, wherein the at least one actuator port is configured to actuate the at least one layer of piezoelectric material via application of an electrical signal to the at least one layer of piezoelectric material, wherein the at least one layer of piezoelectric material is configured to generate a force responsive to the electrical signal; and transmitting the electrical signal to the at least one actuator port.

* * * * *